US008016167B2

(12) United States Patent
Tomkins et al.

(10) Patent No.: US 8,016,167 B2
(45) Date of Patent: Sep. 13, 2011

(54) AEROSOL SPRAYER

(75) Inventors: Steve James Tomkins, Fremont, CA (US); Timothy James Kennedy, Pleasanton, CA (US); Allan Freas Velzy, San Francisco, CA (US); Peter Michaelian, Tappan, NY (US); John Thomas Jacobsen, Miller Place, NY (US); Francois Dominique Claude Laine, San Francisco, CA (US)

(73) Assignee: The Clorox Company, Oakland, CA (US)

( * ) Notice: Subject to any disclaimer, the term of this patent is extended or adjusted under 35 U.S.C. 154(b) by 392 days.

(21) Appl. No.: 12/207,289

(22) Filed: Sep. 9, 2008

(65) Prior Publication Data

US 2010/0059551 A1 Mar. 11, 2010

(51) Int. Cl.
*B65D 83/00* (2006.01)
*B67D 7/58* (2010.01)
*A47G 19/00* (2006.01)

(52) U.S. Cl. ..... 222/402.13; 222/402.15; 222/470

(58) Field of Classification Search ..... 222/402.13, 222/402.15, 383.1, 321.8, 321.7, 321.9, 402, 222/402.1, 401, 402.11, 402.12, 402.14, 222/321.1, 631, 635, 183, 323, 324, 470, 222/472, 473, 474; 215/382, 383, 384; 220/669, 220/675

See application file for complete search history.

(56) References Cited

U.S. PATENT DOCUMENTS

| | | | | |
|---|---|---|---|---|
| 3,189,232 | A | 6/1965 | Joffe | |
| 3,580,432 | A | 5/1971 | Brooks | |
| 3,712,515 | A * | 1/1973 | Corll | 222/182 |
| 3,987,942 | A | 10/1976 | Morane et al. | |
| 4,053,090 | A * | 10/1977 | Kelly et al. | 222/402.13 |
| 4,088,246 | A | 5/1978 | Klingaman | |
| 4,417,673 | A | 11/1983 | Hancock | |
| D320,430 | S | 10/1991 | Renfrew | |
| 5,366,121 | A | 11/1994 | Foster et al. | |
| 5,570,840 | A | 11/1996 | Gettinger et al. | |
| 5,862,960 | A | 1/1999 | Miller et al. | |
| 5,975,377 | A * | 11/1999 | McGowens | 222/402.13 |
| 6,332,562 | B1 | 12/2001 | Sweeton | |
| 6,494,349 | B1 | 12/2002 | Thompson et al. | |
| 7,140,515 | B2 * | 11/2006 | Cardwell et al. | 222/183 |
| 7,204,393 | B2 | 4/2007 | Strand | |
| 7,644,839 | B2 * | 1/2010 | McNulty, Jr. | 222/79 |
| 7,784,650 | B2 * | 8/2010 | Bates et al. | 222/402.13 |
| 2007/0023457 | A1 | 2/2007 | O'Toole et al. | |
| 2007/0051754 | A1 * | 3/2007 | Strand et al. | 222/402.13 |
| 2007/0062980 | A1 | 3/2007 | Bates et al. | |
| 2009/0084870 | A1 * | 4/2009 | Smith et al. | 239/303 |

* cited by examiner

*Primary Examiner* — Kevin P Shaver
*Assistant Examiner* — Stephanie E Williams
(74) *Attorney, Agent, or Firm* — David Peterson

(57) ABSTRACT

A pressurized aerosol sprayer and method of making a pressurized aerosol sprayer are disclosed. In one embodiment the aerosol sprayer includes an aerosol sprayer actuator attached to an aerosol container, wherein the sprayer actuator includes an actuator housing, a trigger piece having a trigger and operatively associated with the actuator housing to activate the release of fluid from the container, a nozzle in fluid communication with the container, and a trigger loop encircling the trigger.

14 Claims, 15 Drawing Sheets

AEROSOL SPRAYER

BACKGROUND OF THE DISCLOSURE

1. Field of the Disclosure

The present invention relates to a pressurized sprayer, a pressurized sprayer actuator, and a method of making the same.

2. Description of Related Art

Pressurized containers of the aerosol type have been traditionally equipped with an actuating button or cap, which button or cap defines a product duct through which the product passes to the discharge orifice situated within the button or cap. To discharge product from the container, the user grasps the container and with one finger of the grasping hand depresses the button or a portion of the cap to release the contents of the container.

While achieving substantial commercial success, finger actuated buttons or caps have the disadvantage of inducing finger fatigue for some users. Moreover, with the prior systems of actuation, the aiming of the discharged product to the desired surface area suffers somewhat due to the relatively awkward gripping and finger placement. A more natural grasping and actuation of the container is achieved through the use of a trigger mechanism. Examples of prior trigger actuated aerosol containers are disclosed in U.S. Pat. Nos. 3,189,232, 3,580,432; 3,987,942; 5,862,960; and 6,494,349. U.S. Pat. App. 2007/0062980 to Bates et al. discloses an aerosol sprayer actuator having a housing fitting on a container with a narrowed waist portion between and upper portion and a lower portion, and the upper portion is configured so that it rests on a portion of a user's thumb and forefinger to at least partially support the weight of the sprayer during use. U.S. Pat. App. 2007/0023457 to O'Toole et al. discloses an aerosol trigger that locks against removal from the aerosol container and has a spring that biases the trigger toward release of the trigger.

In addition, some prior spray containers are only held by a few of the user's fingers. These may result in a less than adequately secure grip, and supporting the weight of the sprayer may place an undue strain on the user's fingers. Therefore, the improved ergonomic pressurized sprayers of the current invention solve problems of carrying the weight of the sprayer, ease of trigger activation and several other problems of prior art sprayers.

SUMMARY OF THE DISCLOSURE

The present invention relates to a sprayer, a sprayer actuator, and a method of making the same. There are numerous embodiments of the sprayer, sprayer actuator, and method described herein, all of which are intended to be non-limiting examples, and there are numerous aspects thereof that may constitute inventions in their own right.

In one embodiment, a pressurized aerosol sprayer with an aerosol sprayer actuator is disclosed. The pressurized aerosol sprayer comprises an aerosol sprayer actuator attached to an aerosol container; wherein the sprayer actuator comprises an actuator housing; a trigger piece having a trigger, a pivot, and a trigger actuating portion; the trigger piece operatively associated with the actuator housing so that the trigger actuating portion activates a valve stem on the container for the release of fluid from the container; a nozzle in fluid communication with the valve stem; and a trigger loop encircling the trigger; wherein the trigger piece has a pivot at one end of the trigger piece and the trigger activating portion at the other end of the trigger piece.

In another embodiment, the pressurized aerosol sprayer comprises an aerosol sprayer actuator attached to an aerosol container; wherein the sprayer actuator comprises an actuator housing, a trigger piece having a trigger and operatively associated with the actuator housing to activate the release of fluid from the container, a nozzle in fluid communication with the container, and a trigger loop encircling the trigger.

In another embodiment, the pressurized aerosol sprayer comprises an aerosol sprayer actuator attached to an aerosol container, wherein the sprayer actuator comprises an actuator housing having a housing top portion with an opening for a nozzle and a housing bottom portion with a trigger opening and a contiguous trigger loop; a trigger piece having a trigger and operatively associated with the actuator housing to activate the release of fluid from the container; a nozzle in fluid communication with the container; and a trigger loop encircling the trigger; wherein the nozzle is in fluid communication with the container by means of a conduit having a first end and a second end, wherein the first end of the conduit is configured to be positioned over a valve stem of the container, and the second end of the conduit has the nozzle operatively associated therewith, wherein the conduit is configured to provide fluid communication between the container and the nozzle; and wherein the trigger piece is at least indirectly in mechanical contact with the valve stem.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF PREFERRED EMBODIMENTS

Figure 1:
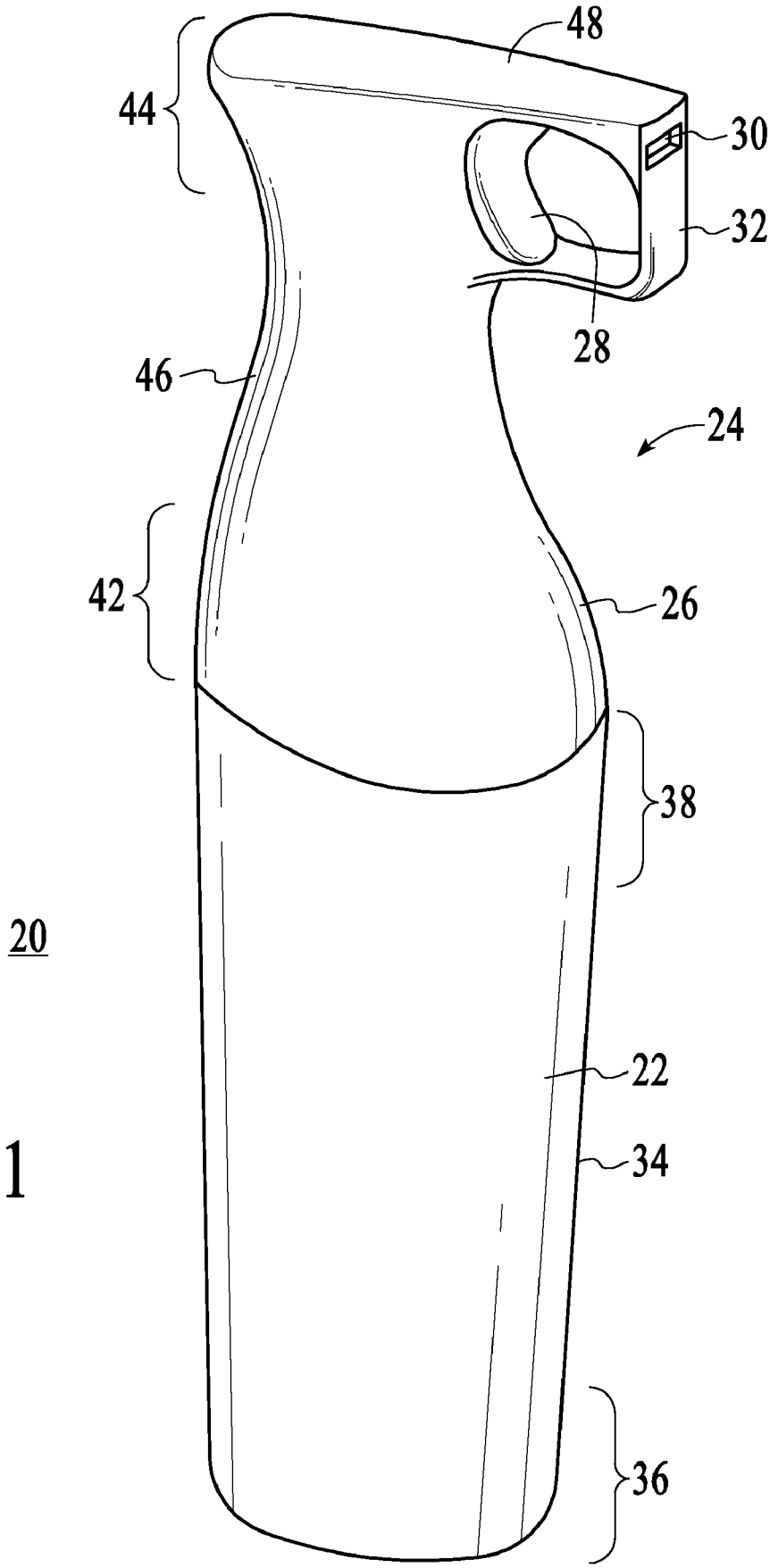
FIG. 1 is a perspective view of one non-limiting embodiment of a container having a sprayer actuator thereon.

The present invention relates to a pressurized aerosol sprayer, a pressurized sprayer actuator, and a method of making the same. FIG. 1 shows one non-limiting embodiment of a pressurized sprayer 20. As shown in FIG. 1, the sprayer (or "spray container") 20 comprises a container 22 and a sprayer actuator (or "actuator") 24. The sprayer actuator 24 comprises a housing 26, a trigger 28, a nozzle 30, and a trigger loop 32.

The container 22 can be any suitable type of container for holding a product to be dispensed by the sprayer. In some embodiments, it is desirable for the container 22 to be capable of holding contents that are under pressure and/or a propellant. The design of such containers in the form of metal cans or plastic containers is well known. The container 22 can be of any suitable shape. The container 22 has sides 34, a lower portion 36, an upper portion 38, and a top 40 (shown in FIG. 2). In the embodiment shown, the container 22 is generally cylindrical, but the sides 34 of the container can taper inwardly with a slightly convex curvature on the upper portion 38 of the container. The container 22 can be, thus, narrower at its upper portion 38. The container 22 can have numerous other shapes in different embodiments. In one embodiment the container has vertical side walls.

The container 22 can contain any suitable product that is capable of being sprayed by the sprayer 20. The product can be in any suitable form, including liquids, and other compositions. Examples of products include, but are not limited to: air freshening compositions, fabric freshening compositions, ironing aids such as spray starches, insecticides, paints, and other industrial, commercial, household, automotive, and/or garden compositions, for example household cleaning compositions.

The container 22 can also include a propellant for dispensing the product therein. Any suitable propellant can be used. Suitable propellants include, but are not limited to: hydrocarbon propellants such as: isobutene, butane, isopropane, dimethyl ether (DME), or non-hydrocarbon propellants such as compressed gases which include, but are not limited to compressed air, nitrogen, inert gases, carbon dioxide, and mixtures thereof. In certain embodiments, such as in the case of air freshening compositions, it may be desirable for the propellant to be substantially free of hydrocarbon propellants.

Figure 3:
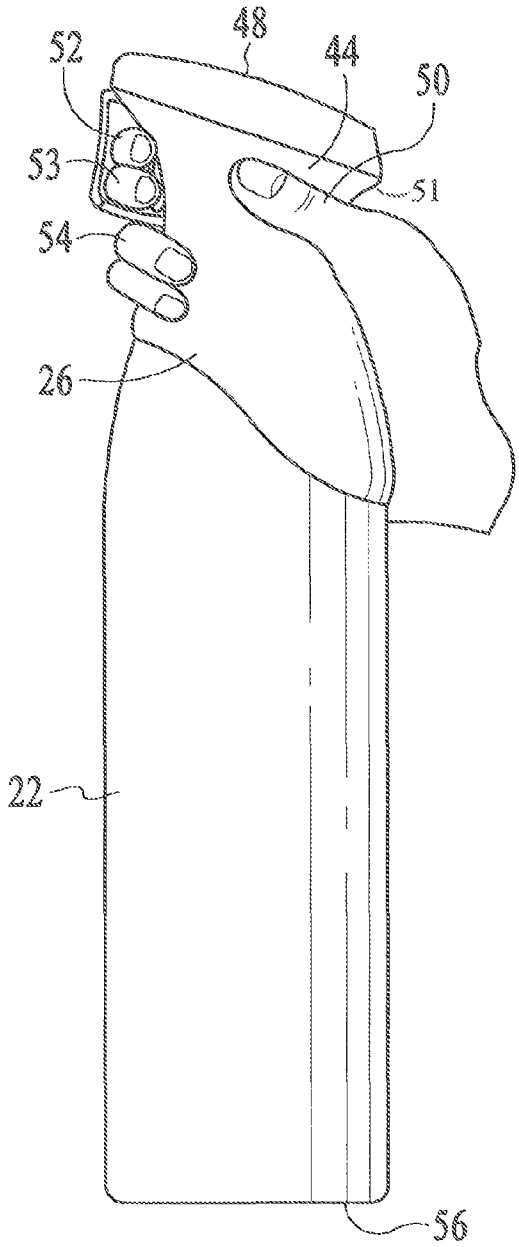
FIG. 3 is side view of one embodiment of the spray container showing a user's hand holding the same.

The actuator housing 26 in the embodiment shown, has a lower portion 42, an upper portion 44, a waist portion 46, and a top 48. The lower portion 42 fits on or over the container 22. The intersection of the actuator housing 26 and the container 22 may be covered by a shrink sleeve that provides a continuous visual flow to the sprayer 20. As shown in FIG. 1, in this embodiment, the waist portion 46 is located between the lower portion 42 and the upper portion 44. The waist portion 46 is narrower than the widest portions of the upper and lower portions. The waist portion 46 provides the sprayer actuator 24 with an ergonomic design. Specifically, as shown in FIG. 3, in this embodiment, actuator housing 26 is configured so that a user can wrap at least their thumb 50 and forefinger 52 around the narrowed waist portion 46 and inside the trigger loop 32. The actuator housing 26 has an extended back section 51 that allows the hand to support the weight of the container. In this embodiment, the sprayer actuator housing 26 is also provided with a configuration that permits it to comfortably fit the natural contour of the user's palm, such as in the crease in the user's palm. Additionally, the user's ring finger 54 can partially support the trigger loop 32 during use. The closed trigger loop 32 allows the weight of the contain to be support both by the forefinger 52 and middle finger 53 on the top of the trigger loop 32 and the ring finger 54 on the bottom of the trigger loop 32. In other embodiments, the forefinger support the top of the loop and the middle and index fingers support the bottom of the loop. The closed trigger loop 32 can also be used as a carrying loop when not in active spraying use. The closed trigger loop 32 also shields the fingers from over-spray and dripping.

In the embodiment shown in the drawings, the top 48 of the actuator housing 26 is tilted upward because the sprayer nozzle 30 is oriented so that liquid sprayed from the nozzle 30 will be directed at an angle of greater than 0° (horizontal) and less than 90° (vertical). That is, the liquid is not sprayed out parallel to the base 56 (that is, horizontally when the base is placed on a horizontal surface), nor is it sprayed out vertically (straight upward in the direction of the axis of the container). In other embodiments, the liquid sprayed from the nozzle 30 is directed at an angle of greater than or equal to about 30° and less than or equal to about 60°. In other embodiments, the liquid sprayed from the nozzle 30 is directed at an angle of about 45°. In other embodiments, the liquid sprayed from the nozzle 30 is directed at an angle of between about 20°-25°.

In other embodiments, however, it may be desirable for the liquid sprayed from the nozzle 30 to be sprayed horizontally (0°) or vertically (90°). In still other embodiments, such as in the case of an ironing aid, it may be desirable for the liquid sprayed from the nozzle 30 to be directed downward toward a surface (at an angle of between 0° and-90°). It is appreciated, however, that spray patterns are typically in the form of dispersions, and the spray emitted from a nozzle will form a dispersed spray pattern angle when viewed from the side. The angles of spray referred to herein are the central axis that bisects such a spray pattern. It is understood that portions of the spray pattern will typically be distributed on either side of this central axis.

The nozzle 30 may be configured to spray droplets of any suitable size. In one non-limiting embodiment, the nozzle 30 is configured to spray a plurality of droplets wherein at least some of the spray droplets have a diameter in a range of from about 0.01 μm to about 500 μm, or from about 5 μm to about 400 μm or from about 10 μm to about 200 μM. The mean particle size of the spray droplets may be in the range of from about 10 μm to about 100 μm, or from about 20 μm to about 60 μm. These size droplets may be useful in the case of air freshening compositions in which it is desired to suspend the droplets in the air for prolonged periods.

The sprayer actuator 24 comprises a trigger 28 operatively associated with the actuator housing 26 at the front of said sprayer. In the embodiment shown, the trigger 28 is also ergonomically designed. The trigger 28 is ergonomic in that it is encircled by the trigger loop 32. In one embodiment, the trigger 28 is convex as in FIG. 4. This permits the user to not only activate the trigger with one finger, such as the user's index finger; it also allows the user to use two or more fingers (such as their index and middle fingers) to activate the trigger 28. This reduces fatigue on the user's index finger in the case of prolonged spraying.

Figure 2:
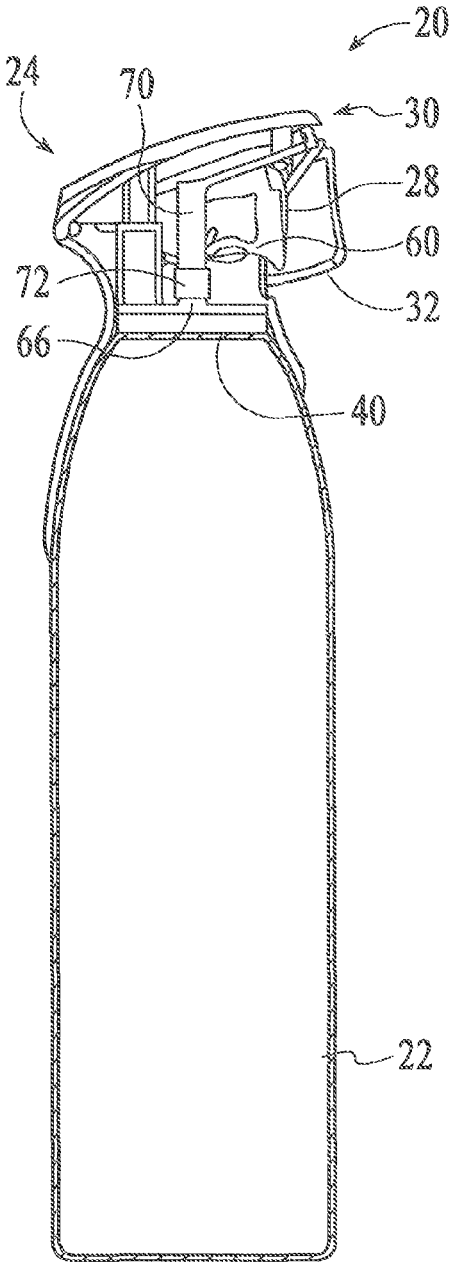
FIG. 2 is a cross-sectional view of one embodiment of the spray container of the invention.
Figure 4:
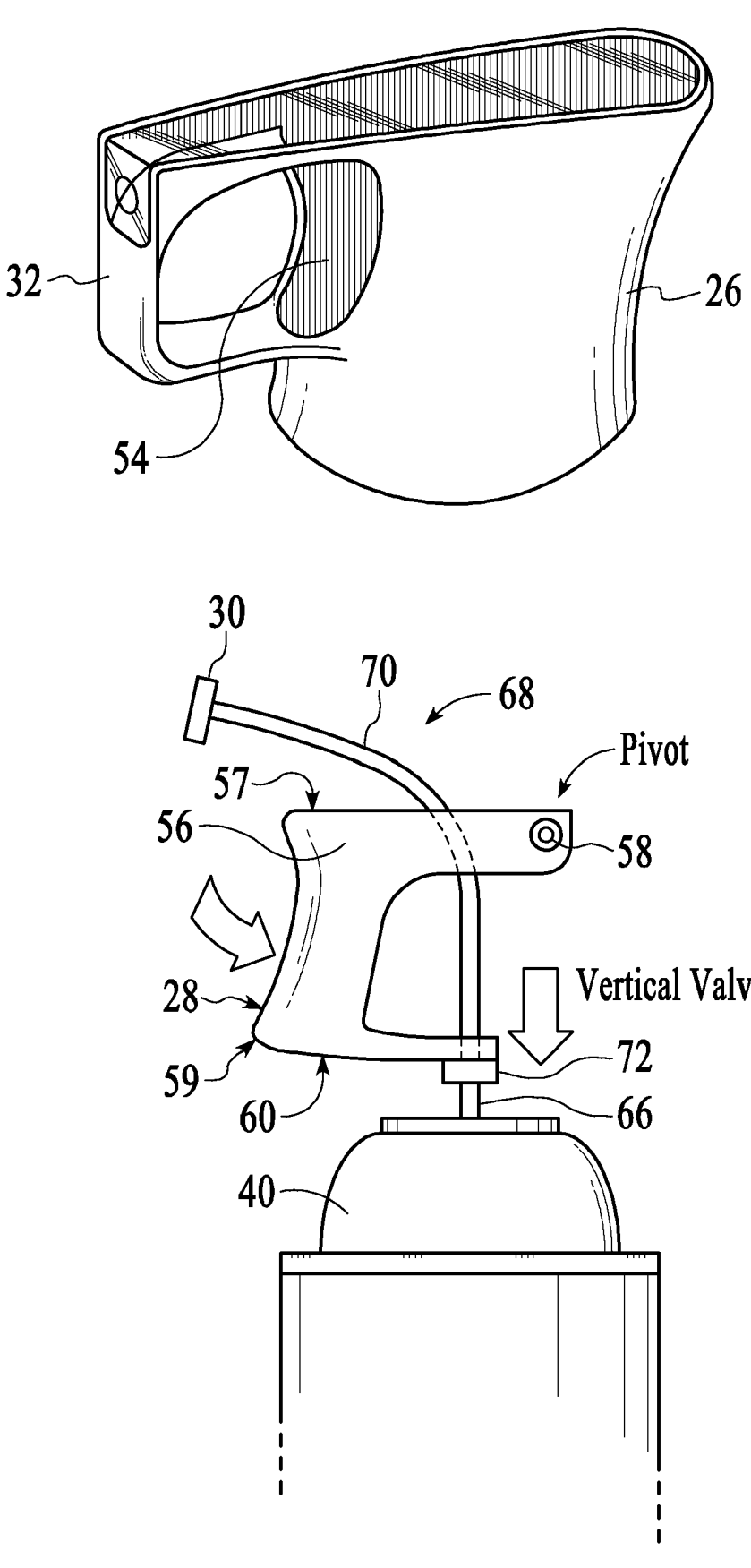
FIG. 4 is an exploded view of one embodiment of the spray container.

FIGS. 2 and 4 show the details of the inside of one embodiment of the sprayer actuator 24. As shown in FIGS. 2 and 4, this embodiment of the sprayer 20, the sprayer actuator 24 comprises the actuator housing 26 and trigger 28 described above. The actuator housing 26 has a hole or opening 54 in the front for the trigger 28 and a continuous trigger loop 32 to provide ergonomic support when using the sprayer. The trigger 28 is part of a larger trigger piece 56, and the rear of the trigger piece 56 has a bar or bars 58 joined thereto, or integrally formed therewith. The trigger piece 56 also comprises a trigger actuating portion 60. Because the trigger piece 56 is closed at both the top 57 and the bottom 59, it prevents pinching the fingers behind the trigger, such as occurs with conventional triggers. The trigger actuating portion 60 is at least indirectly in mechanical contact with the valve stem 66. The bar 58 is configured to fit into recesses or slots (not shown) that are located on the inside of the actuator housing 26, at the rear portion thereof. This allows the trigger piece 56 to pivot in a hinged fashion. The trigger 28, thus, extends from the front of the sprayer 20, and is operatively associated with the actuator housing 26. Further embodiments of the trigger mechanism are described in U.S. Pat. App. 2007/0062980 to Bates et al. and U.S. Pat. App. 2007/0023457 to O'Toole et al., which are both incorporated in their entirety herein.

The container 22, as shown in FIGS. 2 and 4, can have a conventional vertically actuating valve stem 66 extending upward from the top 40 of the container and actuating by movement downward towards the container. The sprayer actuator 24 further comprises a conduit 68. The conduit 68 has a first end and a second end. The conduit 68, in the embodiment shown, comprises several elements. These include: the nozzle 30 at the first end (or front) of the conduit 68; a conduit portion 70; and a cap portion 72 at the second end of the conduit 68. In the embodiment shown in the drawings, the nozzle 30 is held in a fixed location in the front of the actuator housing 26, and the cap portion 72 of the conduit 68 is fit over the valve stem 66 of the container 22. In this embodiment, the conduit 68 serves the dual purpose of channeling the contents of the container 22 to the nozzle 30 where they can be sprayed out of the container 22, and also transmitting a downward force on the valve stem 66 to release the contents of the container 22.

The sprayer actuator 24 works in the following manner. When the user pulls the trigger 28 inward toward the actuator housing 26, this causes the trigger activating portion 60 of the trigger piece 56 to pivot at bar 58 and to press down on the cap portion 72 on the conduit 68. This causes the conduit portion 70 of the conduit 68 to move downward and activates the valve stem 66 of the container. Since the nozzle 30 is in a fixed position, the flexible nature of the conduit portion 70 of the conduit 68 bends and permits this downward movement to take place. The valve stem 66 permits the contents of the container 22 to be released. The contents of the container flow through the conduit 68 and out the nozzle 30. In still other embodiments, the trigger piece 56 and the conduit 68 can be formed as a single integral component.

Figure 5:
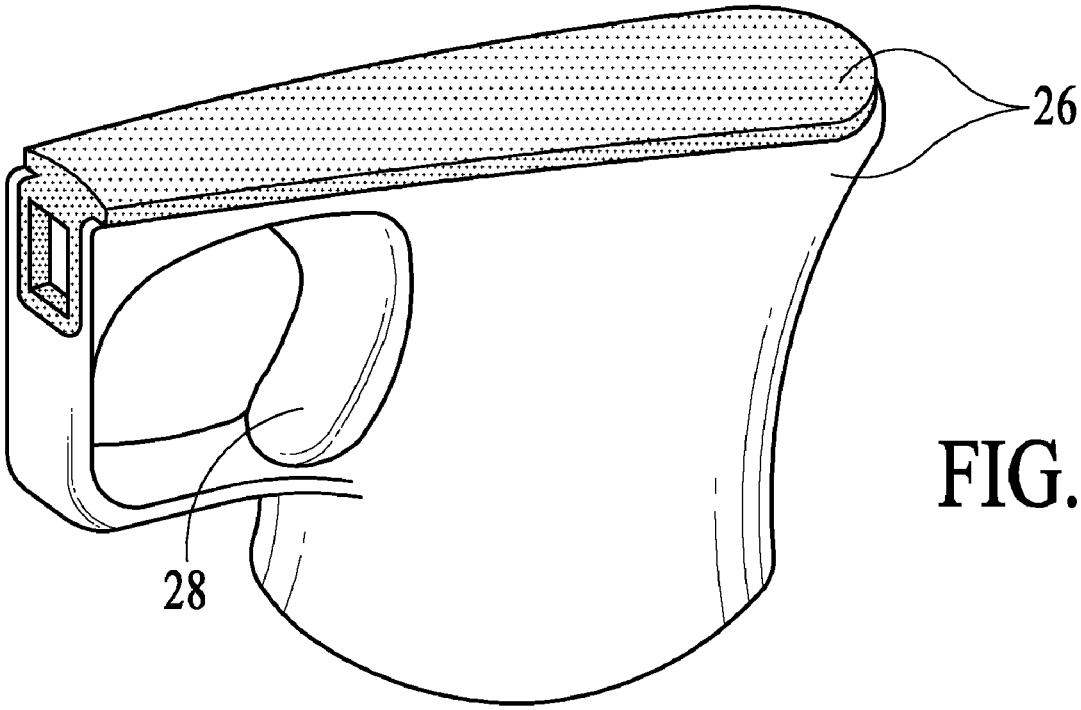
FIG. 5 is a perspective view of one embodiment of the sprayer actuator.
Figure 6:
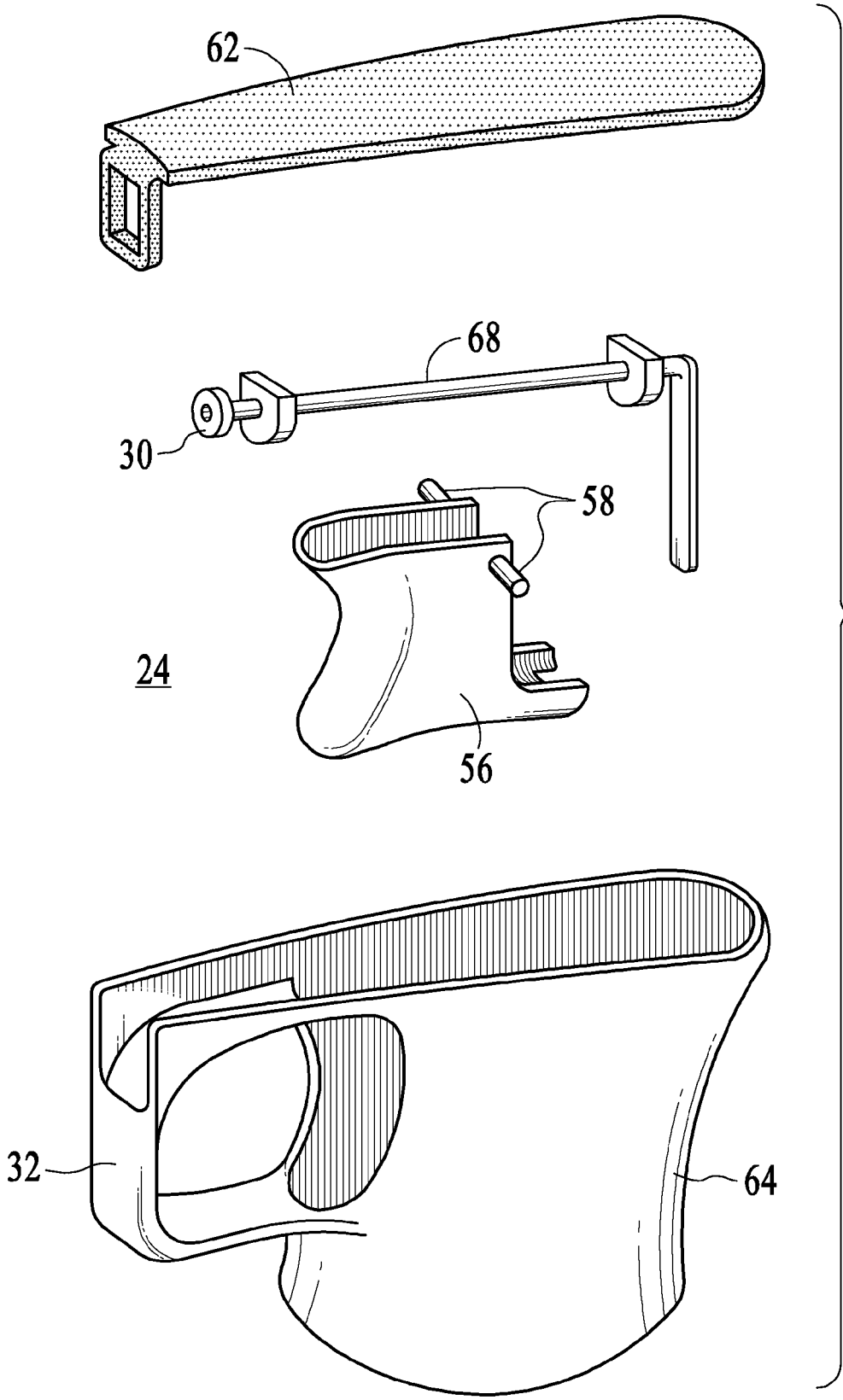
FIG. 6 is an exploded perspective view showing the assembly of the components of one embodiment of the sprayer actuator.

FIG. 5 shows one embodiment of the sprayer actuator 24. FIG. 6 shows an exploded view of the sprayer actuator 24 of FIG. 5 showing a method for assembling some of the components of the sprayer actuator 24. As shown in FIG. 6, the sprayer actuator 24 is assembled as follows. The actuator housing 26 is provided in two portions comprising a housing top portion 62 having an opening for the nozzle 30 and a housing bottom portion 64 having a continuous trigger loop 32 and holding the trigger piece 56 and the conduit 68. The trigger piece 56 is inserted into the bottom portion 64 of the actuator housing so that the bars 58 fit into recesses (not shown) on the inside of the bottom portion 64 of the actuator housing. At least a portion of the trigger piece 56 extends outward through the opening in the front of the housing bottom portion 64 to form a trigger 28. The conduit 68 is inserted into the housing bottom portion 64 of the actuator housing 26 so that it is in fluid communication with the container 22 and operatively associated with the trigger 28. Finally, the housing top portion 62 of the actuator housing 26 is placed on top of the housing bottom portion 64 to form the sprayer actuator.

Figure 7:
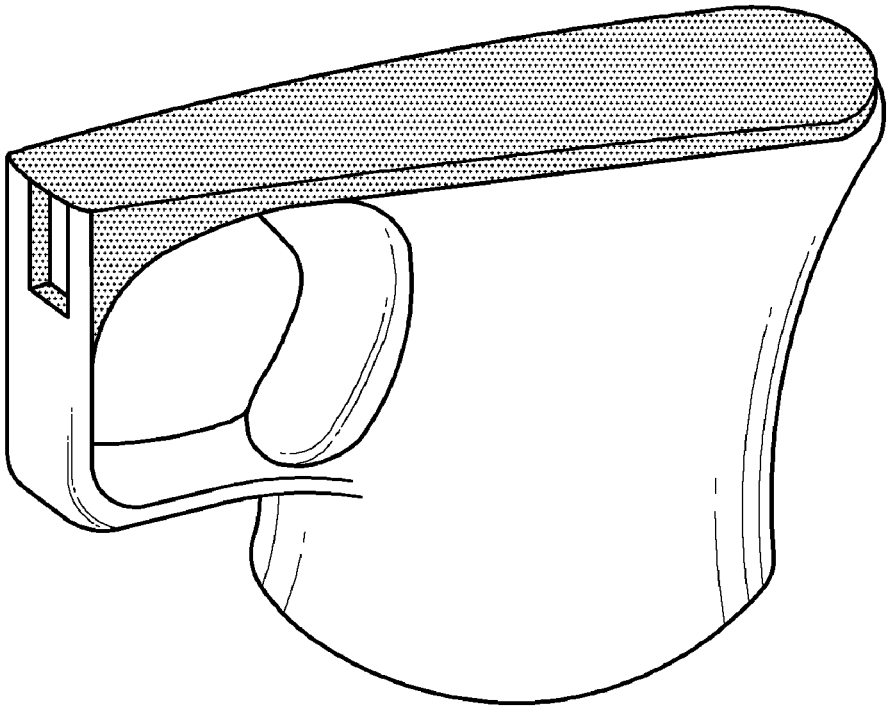
FIG. 7 is a perspective view of one embodiment of the sprayer actuator.
Figure 8:
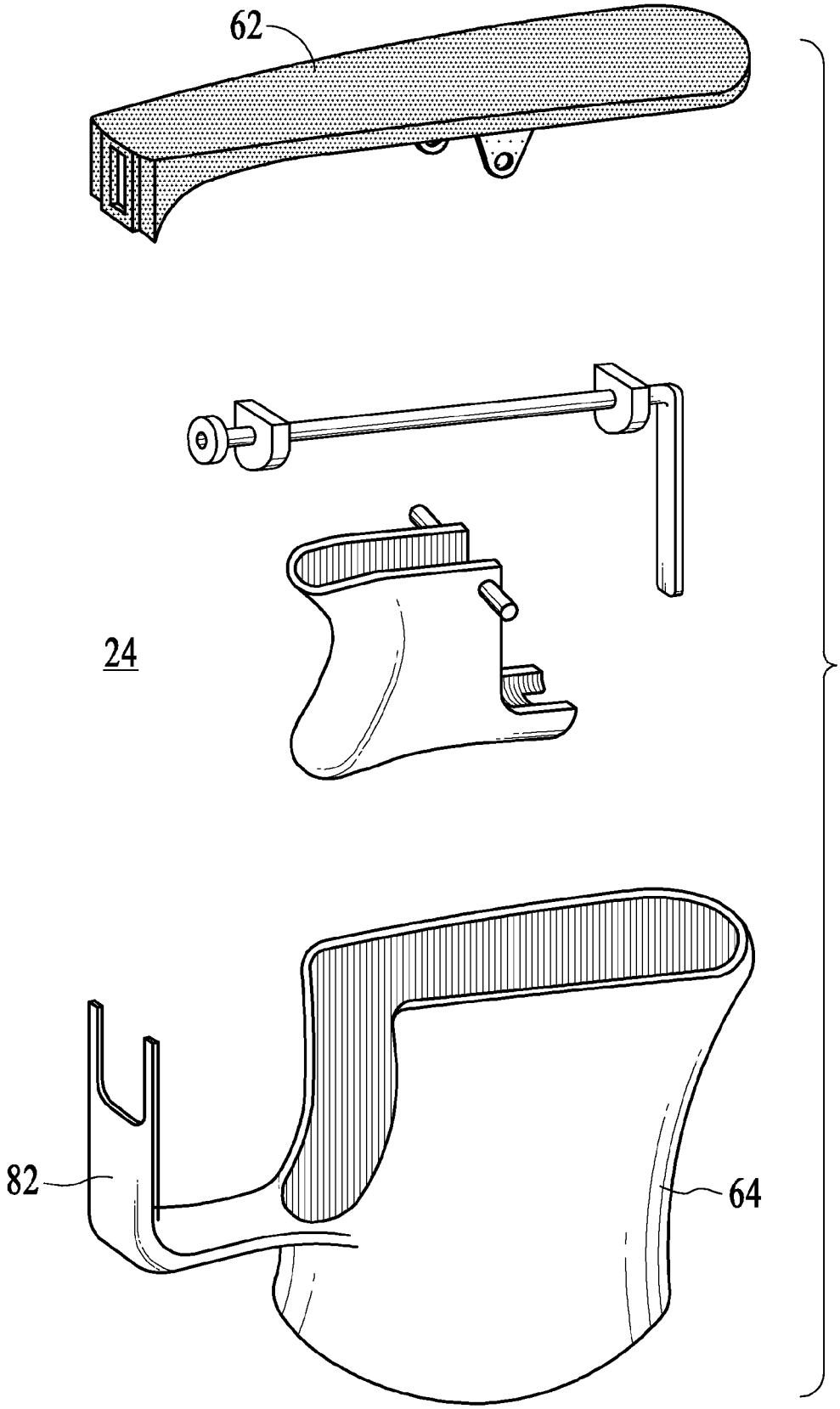
FIG. 8 is an exploded perspective view showing the assembly of the components of one embodiment of the sprayer actuator.

FIG. 7 shows one embodiment of the sprayer actuator 24. FIG. 8 shows an exploded view of FIG. 7 and method of assembly of an embodiment of the sprayer actuator 24 with a housing bottom portion 64 having an trigger loop bottom portion 82 open at the top which is closed by the housing top portion 62.

Figure 9:
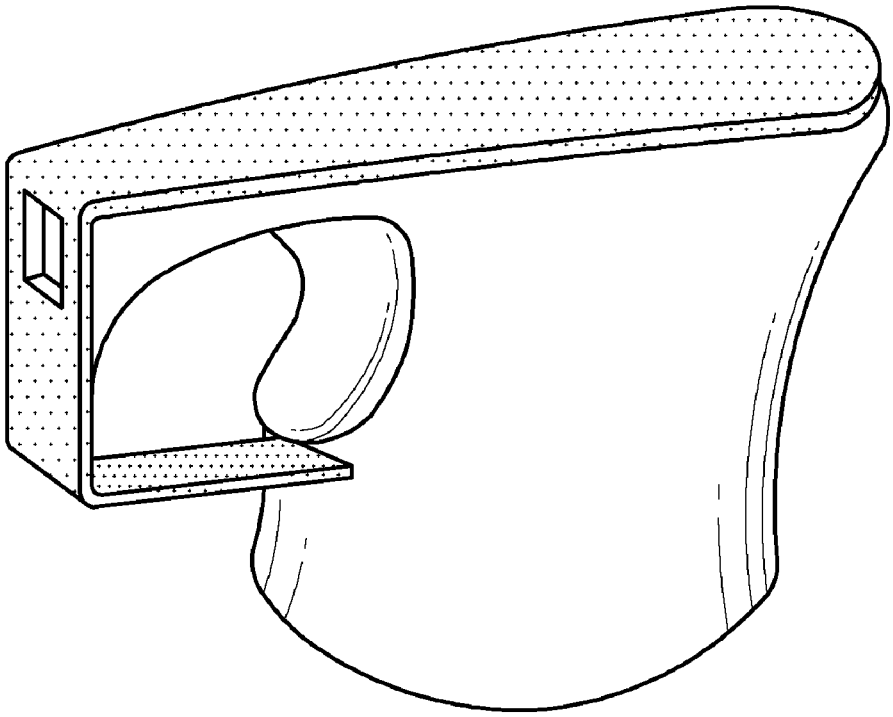
FIG. 9 is a perspective view of one embodiment of the sprayer actuator.
Figure 10:
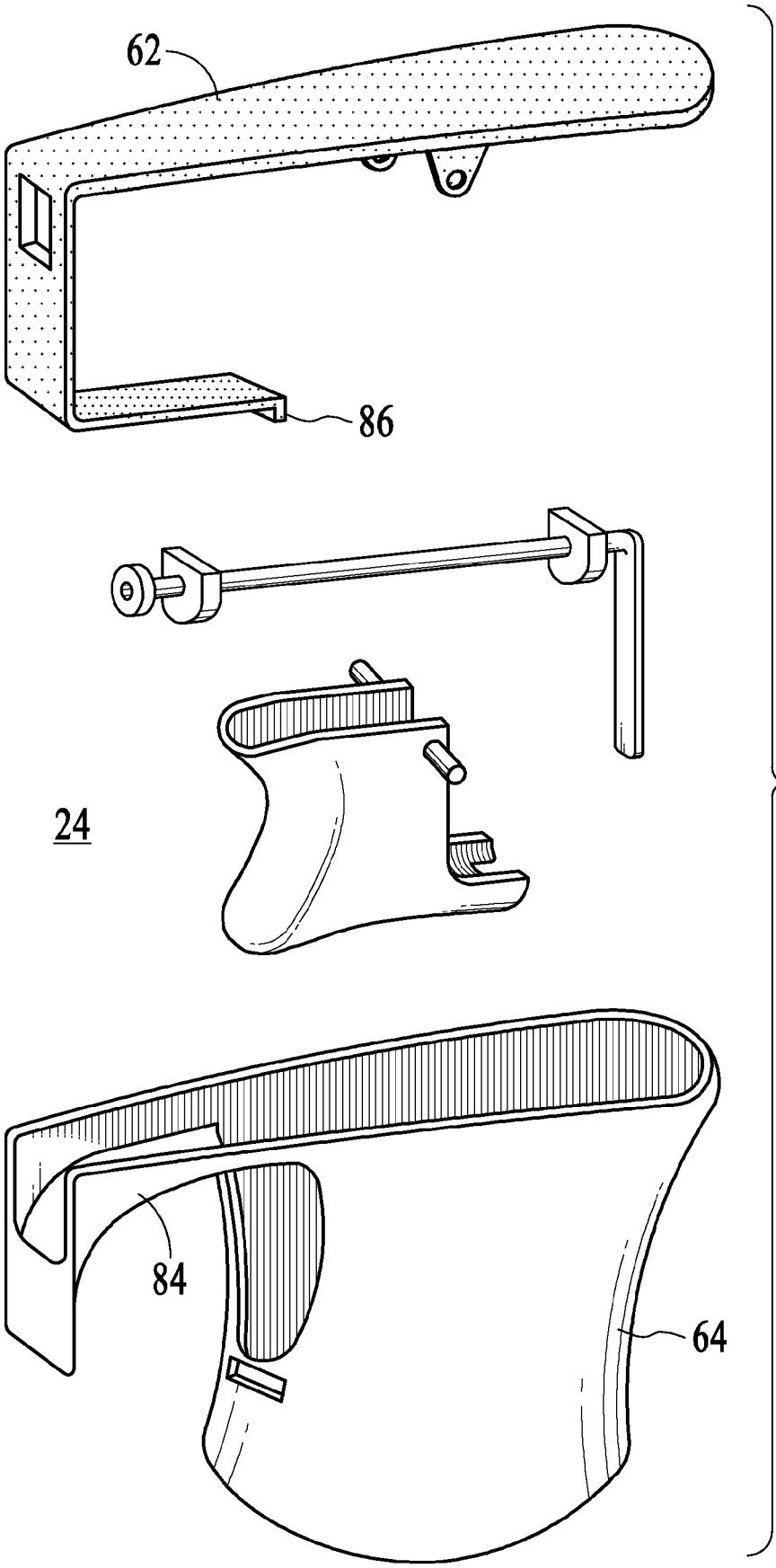
FIG. 10 is an exploded perspective view showing the assembly of the components of one embodiment of the sprayer actuator.

FIG. 9 shows one embodiment of the sprayer actuator 24. FIG. 10 shows an exploded view of FIG. 9 and method of assembly of an embodiment of the sprayer actuator 24 with a housing bottom portion 64 having an open trigger loop top portion 84 open at the top which is closed by the housing top portion 62 having a snap fitment 86 to the housing bottom portion 64.

Figure 11:
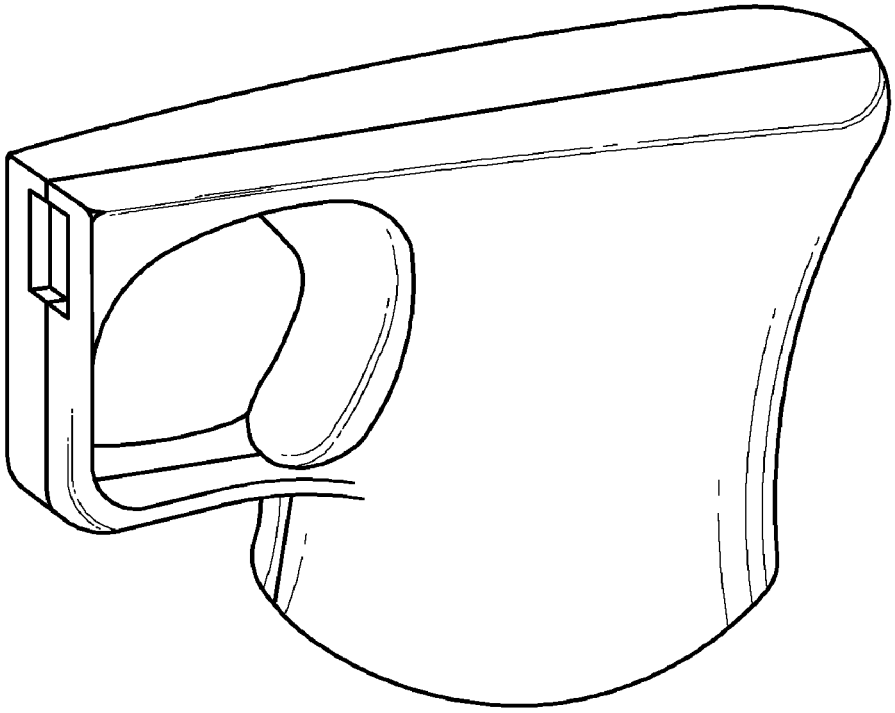
FIG. 11 is a perspective view of one embodiment of the sprayer actuator.
Figure 12:
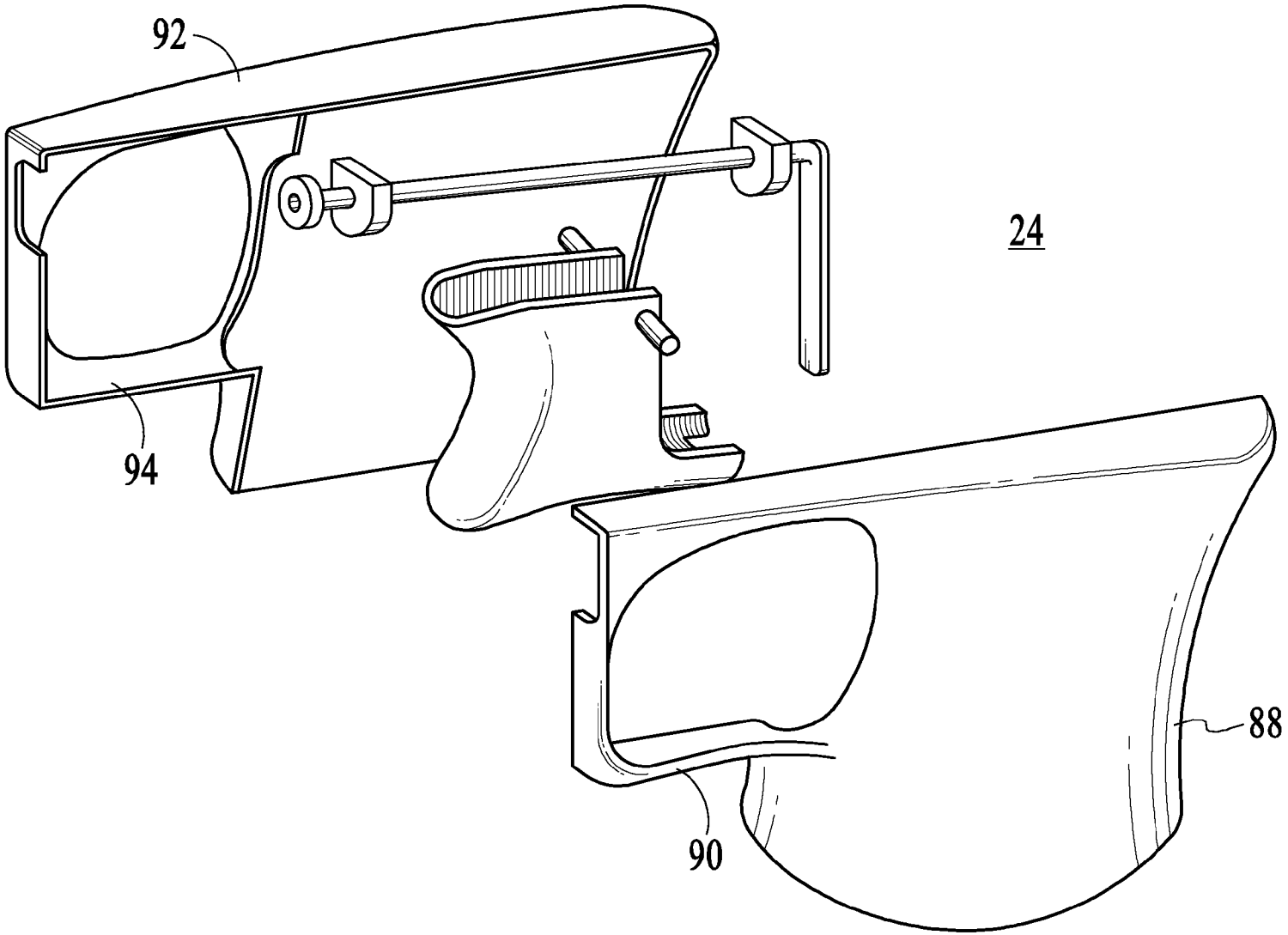
FIG. 12 is an exploded perspective view showing the assembly of the components of one embodiment of the sprayer actuator.

FIG. 11 shows one embodiment of the sprayer actuator 24. FIG. 12 shows an exploded view of FIG. 11 and method of assembly of an embodiment of the sprayer actuator 24 with a housing side portion 88 having an closed trigger loop portion 90 which is closed by a complementary housing side portion 92 having a complementary closed trigger loop portion 94.

Figure 13:
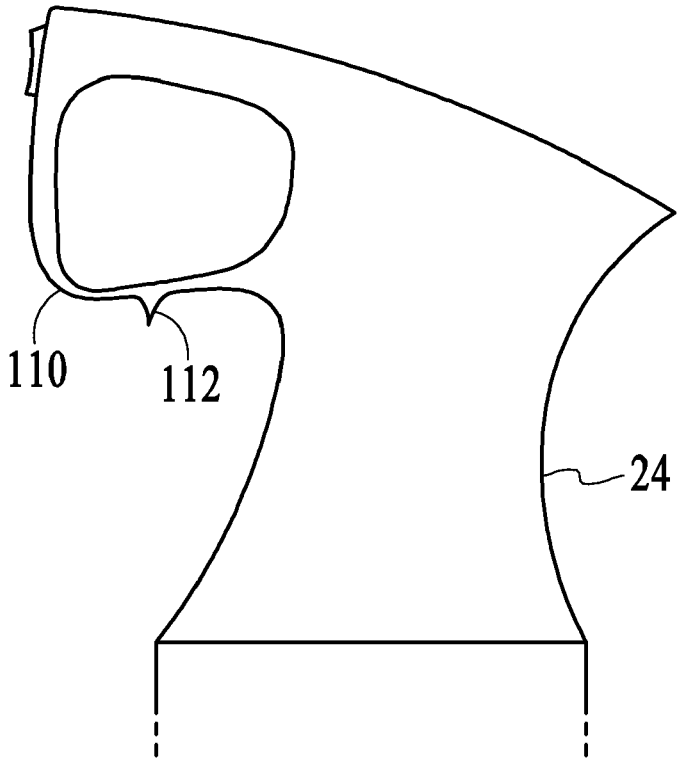
FIG. 13 is a cross-sectional view of one embodiment of the sprayer actuator.
Figure 14:
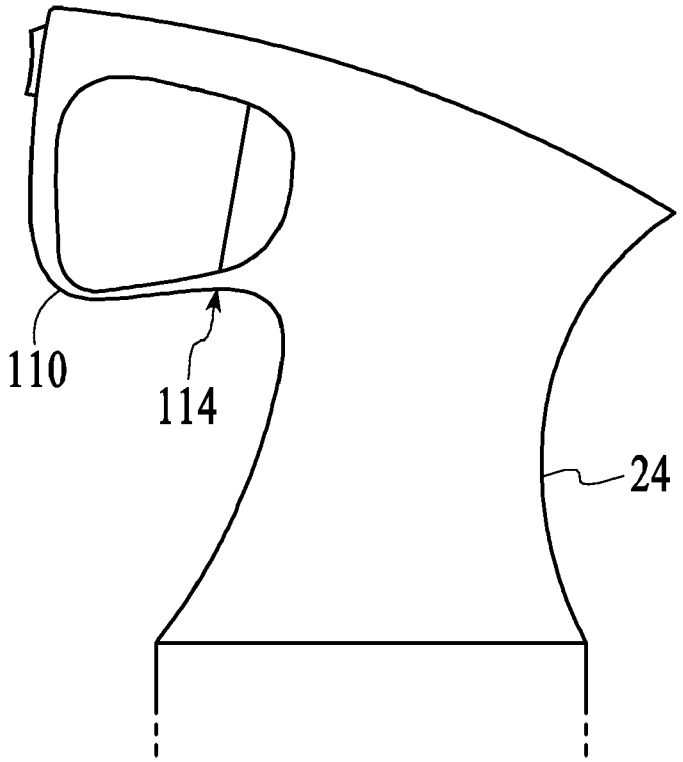
FIG. 14 is a cross-sectional view of one embodiment of the sprayer actuator.

FIG. 13 shows a sprayer actuator 24 having a flat bottom trigger loop portion 110 with a nub 112 for hanging or for drip control. FIG. 14 shows a sprayer actuator 24 with a bottom trigger portion 110 having a pinched-in section 114.

Figure 15:
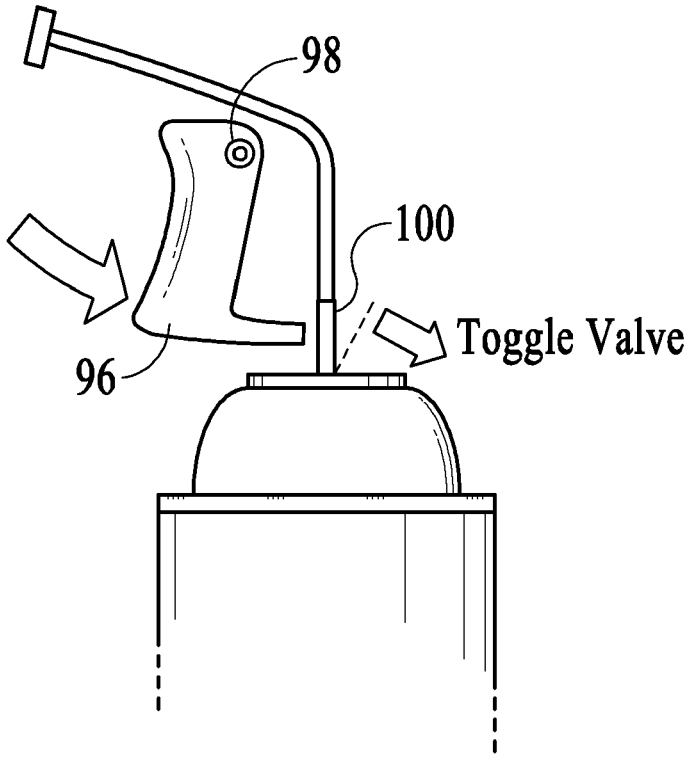
FIG. 15 is a cross-sectional view of one embodiment of the sprayer actuator and spray container.
Figure 16:
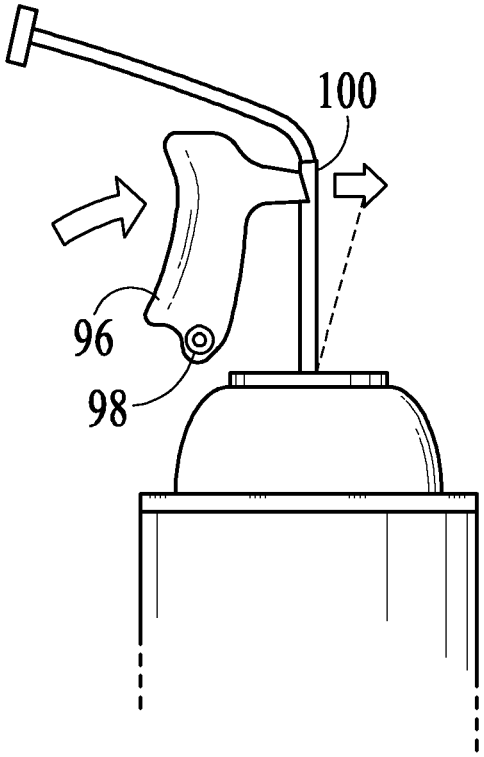
FIG. 16 is a cross-sectional view of one embodiment of the sprayer actuator and spray container.
Figure 17:
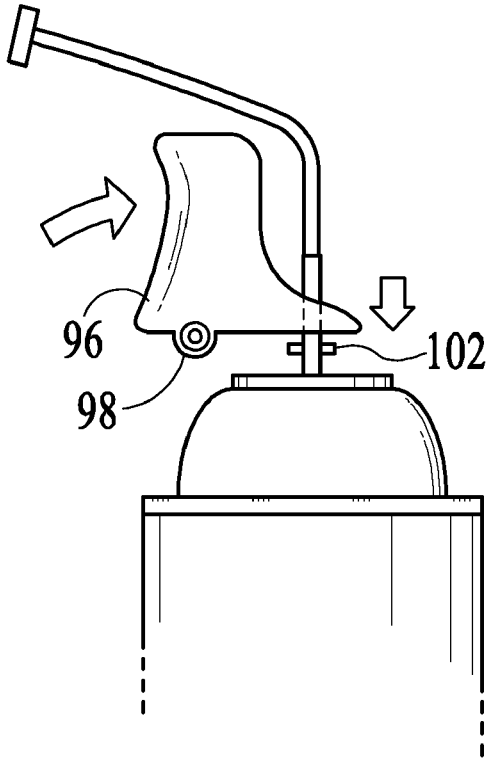
FIG. 17 is a cross-sectional view of one embodiment of the sprayer actuator and spray container.
Figure 18:
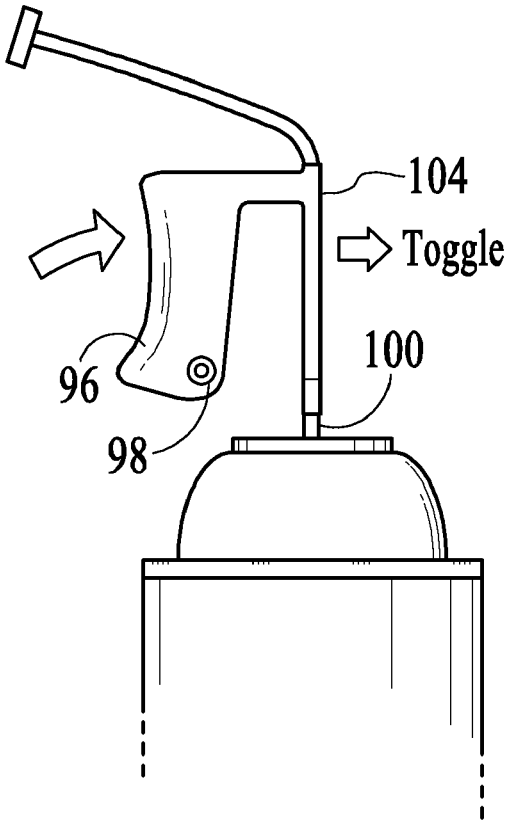
FIG. 18 is a cross-sectional view of one embodiment of the sprayer actuator and spray container.
Figure 19:
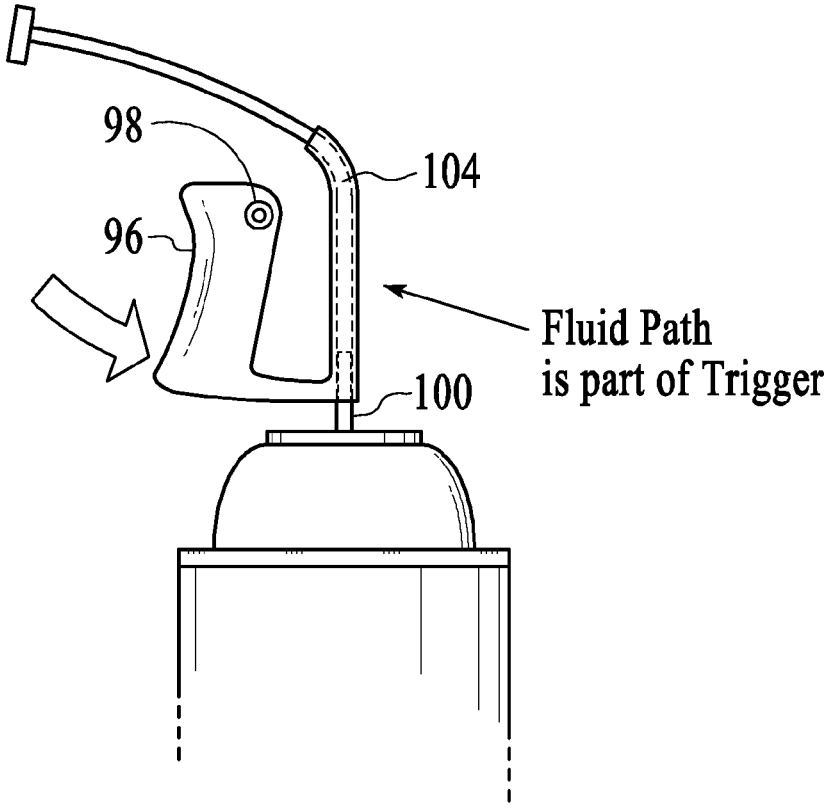
FIG. 19 is a cross-sectional view of one embodiment of the sprayer actuator and spray container.

FIG. 15 shows an alternative internal actuation mechanism using a trigger piece 96 with a top pivot bar 98 which allows the trigger piece 96 to push against a toggle valve 100, which actuates in a direction horizontal to the container. FIG. 16 shows an alternative internal actuation mechanism using a trigger piece 96 with a bottom pivot bar 98 which allows the trigger piece 96 to push against a toggle valve 100. FIG. 17 shows an alternative internal actuation mechanism using a trigger piece 96 with a bottom pivot bar 98 which allows the trigger piece 96 to push against a vertically actuating valve 102. FIG. 18 shows an alternative internal actuation mechanism using a trigger piece 96 with a bottom pivot bar 98 and where the trigger piece 96 has an internal fluid path 104 connected to a toggle valve 100. FIG. 19 shows an alternative internal actuation mechanism using a trigger piece 96 with a top pivot bar 98 and where the trigger piece 96 has an internal fluid path 104 connected to a toggle valve 100.

Figure 20:
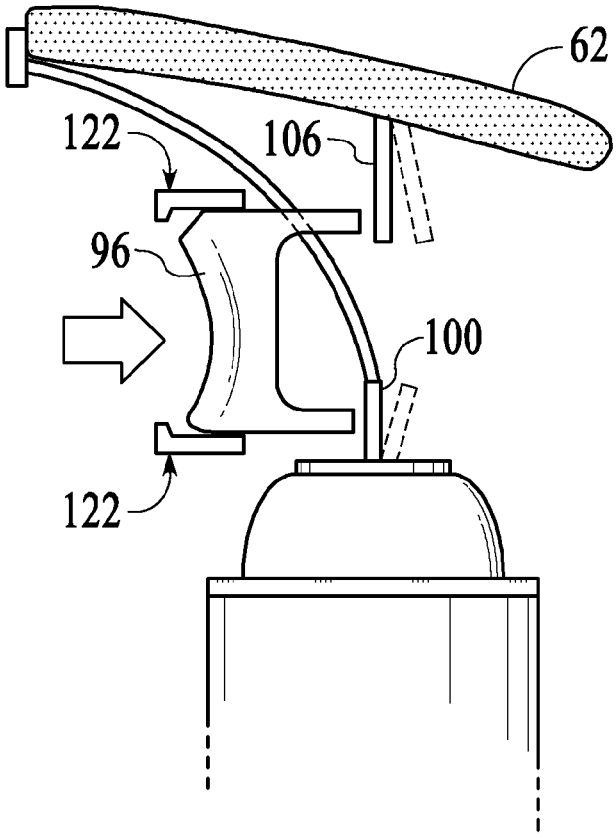
FIG. 20 is a cross-sectional view of one embodiment of the sprayer actuator and spray container.
Figure 21:
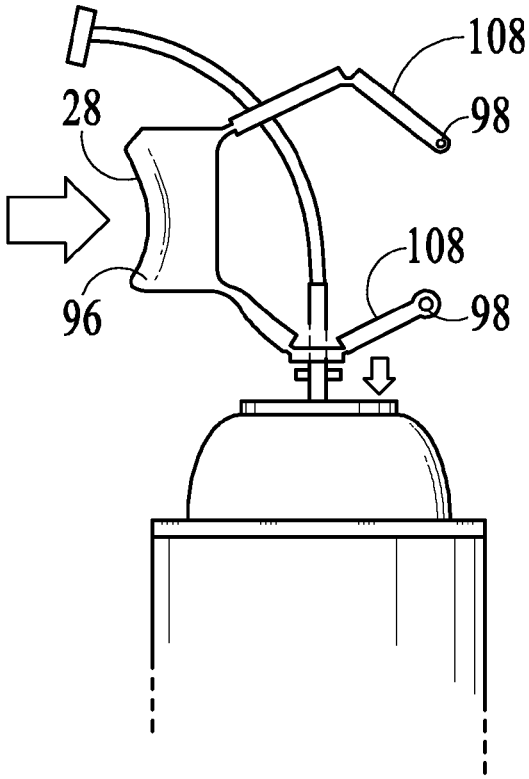
FIG. 21 is a cross-sectional view of one embodiment of the sprayer actuator and spray container.
Figure 22:
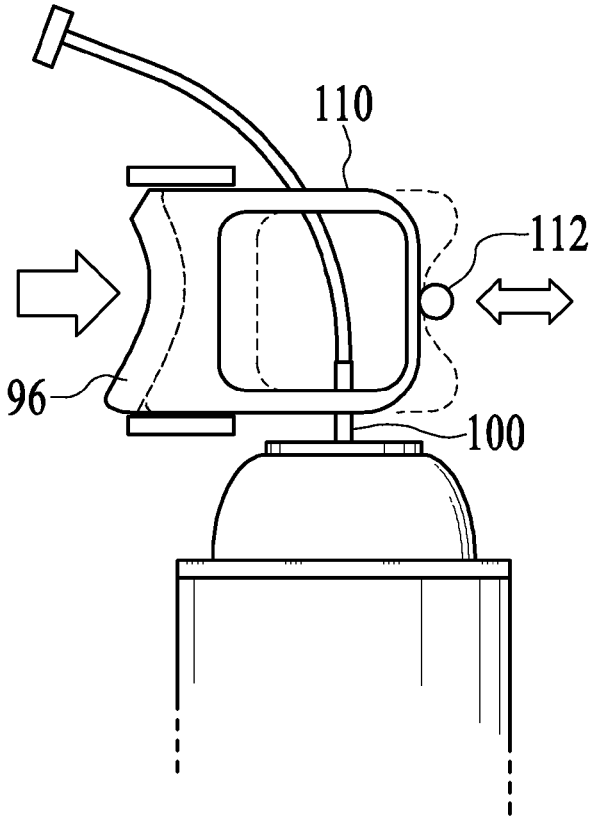
FIG. 22 is a cross-sectional view of one embodiment of the sprayer actuator and spray container.
Figure 23:
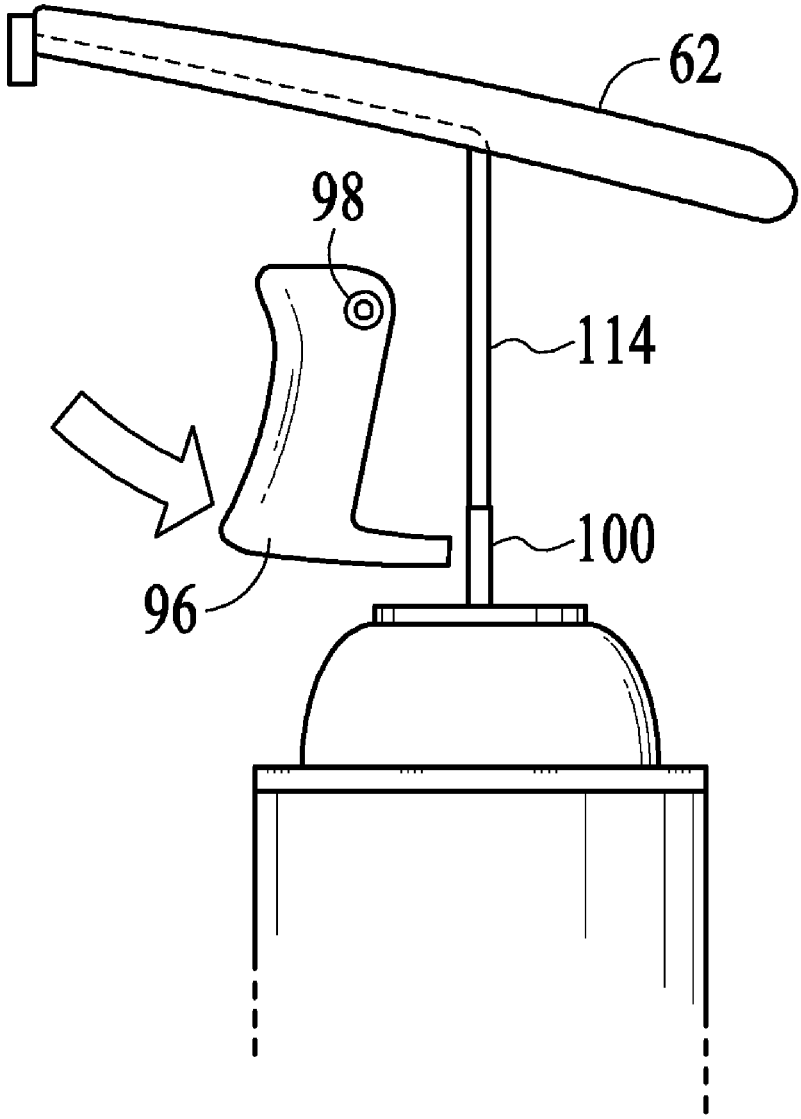
FIG. 23 is a cross-sectional view of one embodiment of the sprayer actuator and spray container.

FIG. 20 shows an alternative internal no pivot actuation mechanism using a trigger piece 96 with no pivot bar and where the trigger piece 96 slides between two spray actuator surfaces 122 to push against a toggle valve 100 at the trigger bottom end and a flexible stem 106 attached to the housing top portion 62 at the trigger top end. FIG. 21 shows an alternative internal no pivot actuation mechanism using a trigger piece 96 with two pivot bars 98 and a pair of living hinge extenders 108 from the trigger 28 to the pivot bars 98 activating a vertically actuating valve 102. FIG. 22 shows an alternative internal no pivot actuation mechanism using a trigger piece 96 with a living spring 110 that pushes the toggle valve 100 and rebounds off a fixed bar 112. FIG. 23 shows an alternative internal actuation mechanism using a trigger piece 96 with a top pivot bar 98 and where the top housing portion 62 has an internal fluid path 114 connected to a toggle valve 100.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the subject invention have been described, it will be obvious to those skilled in the art that various changes and modifications of the subject invention can be made without departing from the spirit and scope of the invention. In addition, while the present invention has been described in connection with certain specific embodiments thereof, it is to be understood that this is by way of illustration and not by way of limitation and the scope of the invention is defined by the appended claims which should be construed as broadly as the prior art will permit.

What is claimed is:

1. A pressurized aerosol sprayer comprising:

a. an aerosol sprayer actuator attached to an aerosol container;

b. wherein the sprayer actuator comprises an actuator housing, a trigger piece having a trigger and operatively associated with the actuator housing to activate the release of fluid from the container, a nozzle in fluid communication with the container, and a trigger loop encircling the trigger;

c. wherein the nozzle is in fluid communication with the container by means of a conduit having a first end and a second end, wherein the first end of the conduit is configured to be positioned over a valve stem of the container, and the second end of the conduit has the nozzle operatively associated therewith, wherein the conduit is configured to provide fluid communication between the container and the nozzle, and the trigger piece is at least indirectly in mechanical contact with the valve stem; and d. wherein the trigger piece has a pivot at the end of each of two living hinge extenders.

2. The sprayer of claim 1, wherein the trigger piece has a pivot at one end of the trigger piece and the trigger activating portion at the other end of the trigger piece.

3. The sprayer of claim 2, wherein the container has a vertical valve connecting the container to the valve stem.

4. The sprayer of claim 2, wherein the container has a toggle valve connecting the container to the valve stem.

5. The sprayer of claim 2, wherein the trigger piece has an internal fluid path fluidly connected to the valve stem.

6. The sprayer of claim 1, wherein the trigger piece slides between two spray actuator surfaces.

7. The sprayer of claim 1, wherein the trigger piece has a living spring that activates a toggle valve on the valve stem of the container.

8. A pressurized aerosol sprayer comprising an aerosol sprayer actuator attached to an aerosol container, wherein the sprayer actuator comprises:

a. an actuator housing having a housing top portion with an opening for a nozzle and a housing bottom portion with a trigger opening and a continuous trigger loop;

b. a trigger piece having a trigger and operatively associated with the actuator housing to activate the release of fluid from the container;

c. a nozzle in fluid communication with the container; and d. a trigger loop encircling the trigger;

e. wherein the nozzle is in fluid communication with the container by means of a conduit having a first end and a second end, wherein the first end of the conduit is configured to be positioned over a valve stem of the container, and the second end of the conduit has the nozzle operatively associated therewith, wherein the conduit is configured to provide fluid communication between the container and the nozzle;

f. wherein the trigger piece is at least indirectly in mechanical contact with the valve stem; and g. wherein the trigger piece has a pivot at the end of each of two living hinge extenders.

9. The sprayer of claim 8, wherein the trigger piece has a pivot at one end of the trigger piece and the trigger activating portion at the other end of the trigger piece.

10. The sprayer of claim 9, wherein the container has a vertical valve connecting the container to the valve stem.

11. The sprayer of claim 9, wherein the container has a toggle valve connecting the container to the valve stem.

12. The sprayer of claim 9, wherein the trigger piece has an internal fluid path fluidly connected to the valve stem.

13. The sprayer of claim 8, wherein the trigger piece slides between two spray actuator surfaces.

14. The sprayer of claim 8, wherein the trigger piece has a living spring that activates a toggle valve on the valve stem of the container.

* * * * *